US005888377A

United States Patent [19]

Bertram

[11] Patent Number: 5,888,377

[45] Date of Patent: Mar. 30, 1999

[54] HYDROCRACKING PROCESS STARTUP METHOD

[75] Inventor: Ricky Val Bertram, Yorba Linda, Calif.

[73] Assignee: UOP LLC, Des Plaines, Ill.

[21] Appl. No.: 994,897

[22] Filed: Dec. 19, 1997

[51] Int. Cl.[6] ..... C10G 65/10

[52] U.S. Cl. ..... 208/59; 208/108; 208/111

[58] Field of Search ..... 208/108, 111, 208/59

[56] References Cited

U.S. PATENT DOCUMENTS

| | | | |
|---|---|---|---|
| 3,213,013 | 10/1965 | Arey, Jr. | 208/111 |
| 3,524,807 | 8/1970 | Lewis, Jr. | 208/111 |
| 3,794,580 | 2/1974 | Ladeur | 208/110 |
| 3,816,296 | 6/1974 | Hass et al. | 208/111 |
| 4,428,825 | 1/1984 | Ward et al. | 208/109 |
| 5,062,943 | 11/1991 | Apelian et al. | 208/111 |
| 5,100,535 | 3/1992 | Chen et al. | 208/111 |
| 5,275,719 | 1/1994 | Baker, Jr. et al. | 208/58 |
| 5,419,830 | 5/1995 | Chou et al. | 209/111 |

OTHER PUBLICATIONS

Zumdahl, S., "Chemistry", D.C. Heath and Company, pp. 484–485, 1989.

*Primary Examiner*—Walter D. Griffin
*Attorney, Agent, or Firm*—Thomas K. McBride; John F. Spears, Jr.

[57] ABSTRACT

The safety, convenience and environmental acceptability of starting a two-stage hydrocracking process unit is increased by employing aqueous ammonia as a selective catalyst poison. The aqueous ammonia is injected into the recycle gas system of the hydrocracking process. The invention eliminates the possibility of forming a large airborne cloud of ammonia gas upon an accidental release of the ammonia stream as is possible with the injection of anhydrous ammonia. The invention also stabilizes the operation of the unit through the use of a maintenance injection rate sufficient to maintain an inlet ammonia content above about 40 ppm.

9 Claims, No Drawings

HYDROCRACKING PROCESS STARTUP METHOD

FIELD OF THE INVENTION

The invention is a method of starting operation of a petroleum refining process used to perform catalytic hydrocracking. The invention more specifically relates to a startup and operation method for a second-stage hydrocracking reaction zone containing highly active fresh or newly regenerated zeolitic catalyst.

RELATED ART

The vast economic importance of the hydrocracking process in modern petroleum refineries has resulted in significant development work aimed at improving the performance of hydrocracking process units. This development has resulted in the development of high activity zeolitic catalysts for use in these units. This high activity gradually decreases during the operation of the process unit due to the accumulation of carbonaceous deposits on the catalyst and through other means of deactivation. The initial high activity of fresh catalyst or newly regenerated catalyst has been recognized as a cause of operational or performance problems. The art has therefore developed methods of reducing the initial activity of fresh or newly regenerated hydrocracking catalyst through the addition of selective catalyst poisons. Many of these poisons contain nitrogen with ammonia being a preferred form of the selective catalyst poison.

U.S. Pat. No. 3,213,013 issued to W. F. Arey, Jr. teaches the injection of nitrogenous bases such as amines or ammonia into a hydrocracking process unit to inhibit the excessive cracking tendencies of fresh catalyst in a manner which allows operation at a constant high temperature in order to obtain a more constant octane number of the gasoline produced in the process.

U.S. Pat. No. 3,794,580 issued to P. Ladeur teaches the injection of ammonia into a hydrocracking process unit in order to promote the production of high viscosity index lubricating oils. U.S. Pat. No. 3,816,296 issued to R. H. Hass et al. teaches the injection of ammonia into the recycle gas stream of a hydrocracking process unit which is processing low nitrogen content feed for the purpose of increasing the selectivity of the process for middle distillate products.

U.S. Pat. No. 4,428,825 assigned to J. W. Ward et al. teaches a hydrocracking process in which ammonia is injected in order to improve the quality of lubricating oils produced from waxy feedstreams by catalytic hydrodewaxing. The products of the process are described as having an increased viscosity index and the process is also described as having a reduced hydrogen consumption.

U.S. Pat. No. 5,275,719 illustrates a different method for setting the ammonia concentration in the second stage of a combined hydroisomerization-hydrotreating process unit. In this process the temperature in the second stage is controlled by regulating the amount of nitrogen-containing compounds which are permitted to enter the second stage from the first stage. This is accomplished by directing at least some of a stripped nitrogen compound containing gas and/or liquid to the second stage. Passing these compounds into the second stage provides a deactivating effect upon the isomerization catalyst necessitating an increase in reaction temperature in order to maintain the rate of conversion.

U.S. Pat. No. 5,419,830 teaches the injection of nitrogenous compounds such as ammonia vapor into a hydrocracking process unit employed for dewaxing. The injection of this compound is to control the balance between isomerization and hydrocracking in the reaction zone, which contains a catalyst comprising a zeolite beta. One embodiment comprises injecting ammonia vapor into the reactor to contact the catalyst in amounts sufficient to prevent a temperature runaway or in order to maintain an operating temperature in the dewaxing reactor below 900° F. This reference also indicates there is a shift from naphtha to middle distillate production with an increasing nitrogen content of the feed.

BRIEF SUMMARY OF THE INVENTION

The invention improves the safety, environmental acceptability and operational convenience of injecting ammonia into a hydrocracking process unit during the startup or operation of the unit. The invention centers upon employing aqueous ammonia, which is liquid phase water containing ammonia at a concentration in the range of from about 5 to 70 wt. % but preferably at a concentration of about 30 wt. %, as a means of injecting the ammonia into the hydrocracking unit. It has been determined that this is an acceptable manner of injecting the ammonia into the unit despite the addition of substantial amounts of water with the ammonia. The subject invention therefore eliminates the need to handle anhydrous ammonia, which is a liquid phase material kept in the liquid form by the imposition of a high pressure. The storage, handling and potential for ammonia gas releases are three safety issues avoided by using aqueous ammonia.

One broad embodiment of the invention may be characterized as a startup method for a hydrocracking process unit comprising a reaction zone containing fresh or newly regenerated hydrocracking catalyst; which startup method comprises injecting aqueous ammonia into the recycle gas line of the hydrocracking process unit at a rate sufficient to maintain an ammonia concentration in the recycle gas entering the reaction zone greater than 20 vppm in the vapor phase.

DETAILED DESCRIPTION AND PREFERRED EMBODIMENTS

Hydrocracking process units are used commercially in large petroleum refineries around the world. These catalytic conversion units process a variety of feeds ranging from naphthas to very heavy residual fractions of crude oil. In general, the hydrocracking process splits the molecules of the feedstream into smaller molecules having a higher average volatility and normally higher economic value. Much work has been devoted to the development of catalysts which are very selective in converting the feed into the desired boiling range products rather than overconverting to lower value molecules. The hydrocracking process also normally improves the quality of the feed material being processed by providing products of higher hydrogen to carbon ratio and by removing sulfur and nitrogen from the feed materials. The sulfur and nitrogen are normally converted to hydrogen sulfide and ammonia which are then removed from the process. The very significant economic utility of the hydrocracking process has resulted in a large developmental effort being devoted to the improvement of the process and to the development of better catalysts for use in the process. A general review and classification of different hydrocracking process flow schemes and a description of hydrocracking catalysts is provided in the book entitled, *Hydrocracking Science and Technoloey* authored by Julius Scherzer and A. J. Gruia published in 1996 by Marcel Dekker, Inc.

The subject invention is directed to a method of moderating the acidity of a catalyst used in hydrocracking. It is believed the subject invention functions because the ammonia molecule becomes attached to an acid site in the catalyst. The acid site is needed for the hydrocracking reaction. The presence of the ammonia molecule means the acid site is not available and hence the activity of the catalyst is reduced. The primary focus of the invention is toward the acidity of zeolitic catalyst components. Many synthetic materials such as ZSM-5 molecular sieves, borosilicate molecular sieves, nonzeolitic molecular sieves and pillared materials also contain acid sites and can be employed as components of hydrocracking catalysts. It is contemplated that the subject application can be employed to moderate the acidity of hydrocracking catalysts in general including hydrocracking catalysts containing any of these several different acidic materials. The invention is therefore not believed limited to application with hydrocracking catalysts comprising a Y zeolite.

When a hydrocracking process unit has been loaded with fresh catalyst or the catalyst in the reactor has been regenerated (in situ or ex situ) the activity of the various catalyst components is much greater than after the process unit has been on stream for some time. The result is that the catalyst will begin to promote the hydrocracking reactions at a relatively low temperature. The hydrocracking reactions are exothermic, and the released heat of the reactions occurring near the inlet of the reactor heats the reactants. As these heated reactants travel through the catalyst bed they contact downstream catalyst and heat this catalyst. This in turn increases the activity of the downstream catalyst. The result is an increase in downstream catalyst activity which can reach the state of an uncontrolled high temperature "runaway". This causes significant overconversion of the feed to low value products. If uncontrolled, the temperature increase can result in damage to the catalyst or in extreme cases damage to the reactor and reactor internal structures. It is an objective of the subject invention to provide a method of controlling the activity of hydrocracking catalysts. It is a specific objective of the invention to provide a startup method for the second stage of a hydrocracking process which is highly susceptible to temperature excursions due to the low ammonia concentration in the feed to the second stage as described below.

The desired "distillate" products of a hydrocracking process are normally recovered as sidecuts of a product fractionation column and include the naphtha, kerosene and diesel fractions. The term "conversion" as used herein refers to the chemical change necessary to convert the feed molecules into product hydrocarbons which are removed in one of the distillate product streams withdrawn from the process. Hydrocarbons removed from the bottom of the product recovery column as a drag stream may be a high value product but are not considered to be either distillates or conversion products for purposes of this definition of conversion. The product distribution of the subject process is set by the feed composition and the selectivity of the catalyst(s) at the conversion rate obtained in the reaction zones at the chosen operating conditions. The subject process is especially useful in the production of middle distillate fractions boiling in the range of about 300°–700° F. (149°–371° C.) as determined by the appropriate ASTM test procedure. The term "middle distillate" is intended to include the diesel, jet fuel and kerosene boiling range fractions. The terms "kerosene" and "jet fuel boiling point range" are intended to refer to about 300°–550° F. (149°–288° C.) and diesel boiling range is intended to refer to hydrocarbon boiling points of about 338 –about 700° F. (170°–371° C.). The gasoline or naphtha fraction is normally considered to be the $C_5$ to 400° F. (204° C.) endpoint fraction of available hydrocarbons. The boiling point ranges of the various product fractions recovered in any particular refinery will vary with such factors as the characteristics of the crude oil source, the refinery's local markets, product prices, etc. Reference is made to ASTM standards D-975 and D-3699-83 for further details on kerosene and diesel fuel properties and to D-1655 for aviation turbine feed. These definitions provide for the inherent variation in feeds and desired products which exists between different refineries. Typically, this definition will require the production of distillate hydrocarbons having boiling points below about 700° F. (371° C.).

The reaction zone should be designed and operated to achieve at least a 40 volume percent conversion of feed compounds boiling above the maximum desired product boiling point. Preferably, the conversion level in a once-through process is above 60 percent and more preferably the conversion level is above 70 percent. The conversion level in the once-through reaction zone is typically lower than in a recycle reaction zone processing the same feed. The total conversion level in a recycle process, processing a light feed, should be above 90 volume percent and is preferably above 95%.

In a representative example of a conventional hydrocracking process, a heavy gas oil is charged to the process and admixed with a hydrocarbon recycle stream. The resultant admixture of these two liquid phase streams is heated in an indirect heat exchange means and then combined with a hydrogen-rich gas stream. The admixture of charge hydrocarbons, recycle hydrocarbons and hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, and other reaction by-products such as hydrogen sulfide and ammonia formed by hydrodesulfurization and hydro-denitrification reactions which occur simultaneously with the hydrocracking reaction. The reaction zone effluent will also contain the desired product hydrocarbons boiling in the gasoline, diesel fuel, kerosene and/or fuel oil boiling point ranges and some unconverted feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from contact with the catalyst bed, heat exchanged with the feed to the reaction zone for heat recovery and then passed into a vapor-liquid separation zone normally including at least one high pressure separator. Additional cooling can be done prior to this separation. In some instances a hot flash separator is used upstream of the high pressure separator. The use of "cold" separators to remove condensate from vapor removed from a hot separator is another option. The liquids recovered in these vapor-liquid separation zones are passed into a product recovery zone containing one or more fractionation columns. Product recovery methods for hydrocracking are well known and conventional methods may be employed in the subject invention. In many instances the conversion achieved in the hydrocracking reactor(s) is not complete and some heavy hydrocarbons are removed from the product recovery zone as a "drag stream", and/or as the hydrocarbon recycle stream. The recycle stream is preferably passed into the hydrotreating reactor, if the overall process includes a hydrotreating reactor, as this reduces the capital cost of the overall unit. It may, however, be passed directly into a hydrocracking reactor. The net drag stream is removed from the hydrocracking process. This allows the use of less severe conditions in the reaction zone(s). The size of the drag stream can be in the broad range of 1–20 volume percent of the process feed stream, but is preferably in the range of 2–10 volume percent..

In some hydrocracking processes two or more hydrocracking reactors are used in series. Plural hydrocracking reactors can be employed in a single-stage flow in which all of the reactants flow in sequence through both reactors. They can also be employed in what is termed a two-stage flow in which some separation occurs between the stages. This separation can range from a simple flashing operation to remove gases including hydrogen sulfide and ammonia to a full fractional distillation which recovers intermediate products. Unconverted recycle hydrocarbons may be charged to either the first or second stage. The hydrotreating which occurs in the first stage of a two-stage hydrocracking unit, plus any upstream hydrotreating, results in the feed to the second stage of a two-stage hydrocracking unit having a very low concentration of hydrogen sulfide and ammonia. These gases tend to moderate the activity of modem zeolitic catalysts. Their absence in the feed and recycle gas to the second stage results in the catalyst having a much higher initial activity and heightens the risk of a temperature "runaway" caused by an uncontrolled reaction rate. The subject invention is primarily directed to controlling the operation, especially during startup of the second stage of the two-stage hydrocracking unit. Reference may be made to the previously cited text *Hydrocracking Science and Technology* for further information on general hydrocracking process flows.

The subject invention is founded upon the recognition of the significant benefits to be obtained by using aqueous ammonia in a startup procedure compared to the prior art use of anhydrous ammonia. The prior art requires handling high pressure liquids and/or gases, with the gases themselves being toxic and dangerous. It is much easier to handle aqueous ammonia, which can be transported and stored at moderate pressures. The release of the same amount of aqueous ammonia does not cause as large of an environmental problem, and aqueous ammonia does not release ammonia into the atmosphere at the same rate as the same volume of liquefied ammonia. A leak of aqueous ammonia is therefore not as likely to cause formation of an ammonia cloud as an equivalent leak of anhydrous ammonia.

The subject invention therefore comprises injecting aqueous ammonia into the relevant reaction zone to increase the ammonia concentration in the entering vapor phase material sufficiently to suppress the tendency of the hydrocracking catalyst to perform cracking at an undesirable rate. This is normally done after the catalyst has been warmed somewhat as by the circulation of hydrogen-rich gas and is done before the feed stream is charged to the reactor. Preferably the inlet temperature of the catalyst bed is at least 100° F. below start of run operating temperature when the ammonia injection is started. Once the reactor has been operating at onstream conditions for some time, e.g., one week, the ammonia injection rate is slowly reduced to a maintenance level or the injection is totally discontinued.

One embodiment of the invention may be characterized as a process for starting operation of a two-stage hydrocracking process unit having a second-stage reaction zone containing fresh or newly regenerated zeolitic hydrocracking catalyst, which startup process comprises the steps of circulating a hydrogen rich gas through the second-stage reaction zone and gradually raising the inlet temperature of the second-stage reaction zone; circulating liquid phase hydrocarbons through the second-stage reaction zone; after the inlet temperature of the reaction zone reaches 350° F., injecting aqueous ammonia into a recycle gas line of the hydrocracking process unit at a rate sufficient to maintain an ammonia concentration in the hydrogen-rich gas entering the second-stage reaction zone greater than 200 vppm.; passing the intended feed stream through the reaction zone while further raising the inlet temperature of the second-stage reaction zone until at least 40 percent conversion of the feed stream is achieved; and, reducing the concentration of ammonia in the inlet to the second-stage reaction zone to between 40 and 150 ppm by reducing the rate of injection of aqueous ammonia and then continuing operation of the process with a positive injection of aqueous ammonia sufficient to maintain an ammonia concentration in this range of 40 to 150 vppm. This gradual reduction in ammonia concentration is coordinated with the overall operation of the process such that the "maintenance level" of ammonia injection is reached sometime shortly after the activity of the catalyst has lined out at a normal processing rate. The reduction is therefore not keyed off the activity of the catalyst or controlled in an attempt to stabilize activity.

The rate of ammonia injection may be quite high at the start of operations, and the ammonia concentration at the inlet to the reaction zone may reach 2,000 vppm or more. In contrast the optional maintenance injection of ammonia after startup is intended to maintain the second-stage recycle gas ammonia concentration at a lower level. A maintenance level above about 30 ppm, preferably above 40 ppm, and most preferably above 100 ppm is suitable for a second stage using a zeolitic noble metal catalyst. This injection rate is intended to counteract the tendency of the recycle gas ammonia concentration of the second stage to wander. This has been found to occur when the liquid phase portion of the reactor effluent from the first stage has a relatively low total nitrogen content; e.g., less than about 20 ppm. Additionally, this has been found to occur when the recycle gas leaving the high pressure separator has an ammonia concentration less than 50 vppm.

It has been discovered that the first 40 to 50 vppm of ammonia content in the recycle gas has the most effect on the catalyst activity. Therefore when the ammonia content is less than 40 vppm, a small variation in ammonia content can have considerable effects on operation. With a low level of nitrogen in the first-stage liquid effluent or a low level of ammonia in the high pressure separator recycle gas, the ammonia concentration in the second-stage recycle gas will not be constant. It can vary enough to require a change in the operating temperature of the second-stage reactor(s). This in turn changes the overall process product distribution and product quality. Such variation is undesirable and the use of maintenance ammonia injection sufficient to maintain a minimum inlet ammonia concentration, which will vary depending on the catalyst, has been found to stabilize unit operation.

The maintenance mode of the subject invention therefore comprises injecting aqueous ammonia into the second stage reactor at a rate sufficient to ensure any variation in ammonia concentration due to changes in operation is overwhelmed by the total ammonia concentration. This is a continuous injection which extends past the initial startup steps.

The customary procedure of injecting water into the effluent of the reaction zone to provide a medium to dissolve salts which would otherwise form from the ammonium and hydrogen sulfide upon the cooling of the reaction zone is practiced in the subject invention. This water injection normally results in the removal of a very large percentage of the ammonia from the reaction zone effluent since there will normally be an excess of hydrogen sulfide. The recycle gas removed from the high pressure separator(s) employed in the process are therefore expected to have a low ammonia concentration. However, the concentration of ammonia in the reactors may be much higher and it is this higher ammonia concentration, which is proportional to the nitrogen content of the feed, that is addressed by the subject process.

While it is also known in the art that water can be injected into a hydrocracking unit as described in U.S. Pat. No. 3,706,658, it is believed this has not included aqueous ammonia. If this water injection is performed in conjunction with the subject invention, it may lead to excessive water being present in the reaction zone. This is measured in terms of damage to the catalyst and/or a negative impact to the selectivity and conversion achieved in the process. The interstage separation of a two-stage unit may prevent some or most of the water injected into the first stage from reaching the second stage which is the preferred location for use of this invention. In general, the total water concentration in the reactants entering the second stage of a two-stage hydrocracking reactor containing a noble metal catalyst should be maintained at less than 13000 ppm, with the rate of aqueous ammonia injection being adjusted to control this concentration. For a base metal catalyst a water concentration up to 26,000 ppm is believed acceptable.

The subject invention can be employed in both single-stage and two-stage hydrocracking units. While each stage will comprise at least one reactor, a "stage" in a hydrocracking unit is not synonymous with a reactor and a stage may contain two or three reactors. In addition a single reactor may contain two or more types of catalyst such as hydrotreating and hydrocracking catalyst. The defining characteristic of a two-stage unit is the presence of a vapor-liquid separation between the stages plus some means of reducing the carryover of ammonia and hydrogen sulfide from the first stage to the second stage. The injection of water sufficient to allow collection of a separate water phase recovered from the first stage effluent is one such means of removing these reaction by-products as the water will contain ammonium sulfate salts. The effluent of the first stage may be depressured as by flashing into a vapor-liquid separator or the effluent may be passed into a fractionation column which can strip out light ends or naphtha boiling range hydrocarbons. The latter procedures result in the production of a first-stage liquid effluent having a very low level of hydrogen sulfide and ammonia. If the hydrotreating performed in the first stage is effective and/or the feed to the first stage is low in nitrogen, the total nitrogen content of the first stage liquid product will also be low. This liquid is the feed to the second stage.

Often the net gas recovered from the first-stage effluent is purified for the removal of hydrogen sulfide before being recycled. The total net gas may return to the first stage, but a portion of the treated gas could flow into the second stage. More commonly some of the second-stage net gas is allowed to pass into the first stage as makeup gas to the first stage, with the makeup hydrogen for the overall process being charged to the second stage. Unconverted hydrocarbons may also be recycled to the first stage.

The ammonia concentration in the reaction zone processing a feed having a higher nitrogen content will increase faster and reach a higher level. Thus the catalyst in this reaction zone, typically the first stage, will suffer from a higher degree of acid cite poisoning by ammonia than an equivalent catalyst in the other reaction zone. The catalyst in the first stage may contact a raw feed or a hydrotreated feed plus ammonia generated during hydrotreating and is therefore less likely to be susceptible to a temperature runaway than catalyst in the second stage.

The vapor-liquid separation zone concentrate(s) the hydrogen present in the reaction zone effluent stream into a vapor phase stream. This produces the hydrogen recycle stream which may be passed through a hydrogen sulfide removal zone and limits hydrogen entry into the fractionation columns. Makeup hydrogen is admixed into the reactor feed stream or hydrogen recycle stream as required to maintain the desired hydrogen partial pressure in the reactors. Two or more individual vapor-liquid separators may be employed in series between the reactors and the fractionation column. They may operate at greatly different pressures and temperatures. For instance, the liquid phase hydrocarbons recovered in a high pressure vapor-liquid separator are often passed into a low pressure flash separator. The liquid from the low pressure flash separator is passed into a product recovery fractionation column. The product recovery fractionation column is designed and operated to separate the entering hydrocarbons based upon their relative volatility into a number of different product streams, the recycle stream and the drag stream. The lightest stream removed from the fractionation column comprises the overhead stream which will normally comprise methane through butane with some small amounts of heavier compounds. A stream of naphtha boiling range hydrocarbons and one or more heavier distillate product streams which may be kerosene or diesel fuel boiling range product streams are also removed from this column.

While being referred to as "unconverted hydrocarbons", the recycle hydrocarbons have been passed through any hydrotreating reactor which is used and at least one of the hydrocracking zones employed in the process and therefore will have different overall characteristics than the raw feed stream. The recycle stream may have a reduced content of sulfur and nitrogen compared to the feed stream but will on average be slightly harder to crack than the process feedstream as a result of the remaining unconverted hydrocarbons being richer in cyclic paraffins than the feed.

Suitable feedstocks for the subject process include virtually any heavy hydrocarbonaceous mineral or synthetic oil or a mixture of one or more fractions thereof. Thus, such known feedstocks as straight run gas oils, vacuum gas oils, demetallized oils, deasphalted vacuum residue, coker distillates, cat cracker distillates, shale oil, tar sand oil, coal liquids and the like are contemplated. The preferred feedstock will have a boiling point range starting at a temperature above about 260° Celsius (500° F.) and does not contain an appreciable concentration of asphaltenes. The feed stream should have a boiling point range falling between 260°–538° C. Preferred first stage feedstocks include gas oils having at least 50% volume of their components boiling above 371° C. (700° F.). The hydrocracking feedstock may contain nitrogen, usually present as organo nitrogen compounds in amounts between 1 ppm and 1.0 wt. %. The feed will normally also contain sulfur containing compounds sufficient to provide a sulfur content greater than 0.15 wt. %.

Hydrocracking conditions employed in the subject process are those customarily employed in the art for hydrocracking. Hydrocracking reaction temperatures are in the broad range of 400° to 1200° F. (204°–649° C.), preferably between about 600° and 950° F. (316°–510° C.). Reaction pressures are preferably between about 1000 and about 3000 psi (13,780–24,130 kPa). A temperature above about 316° C. and a total pressure above about 8270 kPa (1200 psi) are highly preferred. Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178–8, 888 std. $m^3/m^3$), preferably between 2,000 and 30,000 scf per barrel of charge (355–5,333 std. $m^3/m^3$).

Suitable catalysts for use in all reaction zones of this process are available commercially from a number of vendors including UOP, Haldor-Topsoe and Criterion Catalyst Company. It is preferred that the hydrocracking catalyst comprises between 1 wt. % and 90 wt. % Y zeolite, preferably between 10 wt. % and 80 wt. %. The zeolitic catalyst composition should also comprise a porous refractory inorganic oxide support (matrix) which may form between about 10 and 99 wt. %, and preferably between 20 and 90 wt. % of the support of the finished catalyst composite. The matrix may comprise any known porous refractory inorganic oxide such as alumina, magnesia, silica, titania, zirconia, silica-alumina and the like and preferably comprises a combination thereof such as alumina and silica-alumina. The most preferred matrix comprises a mixture of silica-alumina and alumina wherein the silica-alumina comprises between 15 and 85 wt. % of said matrix. It is also preferred that the support comprises from about 5 wt. % to about 45 wt. % alumina.

A Y zeolite has the essential X-ray powder diffraction pattern set forth in U.S. Pat. No. 3,130,007. The as synthesized zeolite may be modified by techniques known in the art which provide a desired form of the zeolite. Thus, modification techniques such as hydrothermal treatment at increased temperatures, calcination, washing with aqueous acidic solutions, ammonia exchange, impregnation, or reaction with an acidity strength inhibiting specie, and any known combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2:Al_2O_3$ ratio greater than 6, most preferably between 6 and 25. The Y zeolites produced by UOP of Des Plaines, Ill. under the trademarks Y-82, Y-84, LZ-10 and LZ-20 are suitable zeolitic starting materials. These zeolites have been described in the patent literature. It is contemplated that other zeolites, such as Beta, Omega, L or ZSM-5, could be employed as the zeolitic component of the hydrocracking catalyst in place of or in addition to the preferred Y zeolite.

The silica-alumina component of the hydrocracking or hydrotreating catalyst may be produced by any of the numerous techniques which are well described in the prior art relating thereto. Such techniques include the acid-treating of a natural clay or sand, coprecipitation or successive precipitation from hydrosols. These techniques are frequently coupled with one or more activating treatments including hot oil aging, steaming, drying, oxidizing, reducing, calcining, etc. The pore structure of the support or carrier commonly defined in terms of surface area pore diameter and pore volume, may be developed to specified limits by any suitable means including aging a hydrosol and/or hydrogel under controlled acidic or basic conditions at ambient or elevated temperature.

An alumina component of the catalysts may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The finished catalysts for utilization in the subject process should have a surface area of about 200 to 700 square meters per gram, an average pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2/g$ are greatly preferred.

The composition and physical characteristics of the catalyst such as shape and surface area are not considered to be limiting upon the utilization of the present invention. The catalyst may, for example, exist in the form of pills, pellets, granules, broken fragments, spheres, or various special shapes such as trilobal extrudates, disposed as a fixed bed within a reaction zone. Alternatively, the hydrocracking catalyst may be prepared in a suitable form for use in moving bed reaction zones in which the hydrocarbon charge stock and catalyst are passed either in countercurrent flow or in co-current flow. Another alternative is the use of a fluidized or ebulated bed hydrocracking reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow. The catalyst particles may be prepared by any known method in the art including the well-known oil drop and extrusion methods.

A preferred form for the catalysts used in the subject process is an extrudate. The well-known extrusion method involves mixing the molecular sieve, either before or after adding metallic components, with the binder and a suitable peptizing agent to form a homogeneous dough or thick paste having the correct moisture content to allow for the formation of extrudates with acceptable integrity to withstand further handling and subsequent calcination. Extrudability is determined from an analysis of the moisture content of the dough, with a moisture content in the range of from 30 to 50 wt. % being preferred. The dough then is extruded through a die pierced with multiple holes and the spaghetti-shaped extrudate is cut to form particles in accordance with techniques well known in the art. A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form, such as spheres, by any means known to the art.

A spherical catalyst may be formed by use of the oil dropping technique such as described in U.S. Pat. Nos. 2,620,314; 3,096,295; 3,496,115 and 3,943,070 which are incorporated herein by reference. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. The resulting aged and gelled particles are then washed and dried at a relatively low temperature of about 50°–200° C. and subjected to a calcination procedure at a temperature of about 450°–700° C. for a period of about 1 to about 20 hours. This treatment effects conversion of the hydrogel to the corresponding alumina matrix. The zeolite and silica-alumina must be admixed into the aluminum containing sol prior to the initial dropping step. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

Hydrogenation components may be added to the catalysts before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on techniques for the preparation of hydrocracking catalysts may be obtained by reference to U.S. Pat. Nos. 3,929,672; 4,422,959; 4,576,711; 4,661,239; 4,686,030; and, 4,695,368 which are incorporated herein by reference.

Hydrogenation components contemplated for use in the catalysts are those catalytically active components comprising a metal selected from the group consisting of nickel, molybdenum, tungsten, cobalt, platinum, palladium. The metal may be present as an oxide, sulfide or other compound. It is preferred that the catalyst comprise only one or two base metals or only one of the noble metals, such as platinum or palladium. The use of platinum or palladium is highly preferred.

What is claimed:

1. A process for starting operation of a two-stage hydrocracking process unit having a second-stage reaction zone containing fresh or newly regenerated zeolitic hydrocracking catalyst, which startup process comprises the steps of:

a) circulating a hydrogen-rich recycle gas stream through the second-stage reaction zone and gradually raising the inlet temperature of the reaction zone;

b) beginning circulation of liquid phase hydrocarbons through the second-stage reaction zone;

c) beginning injection of aqueous ammonia into the recycle gas line of the hydrocracking process unit at a rate sufficient to maintain an ammonia concentration in the recycle gas stream entering the second-stage reaction zone greater than 500 ppm when the inlet temperature of the second-stage reaction zone reaches 350° F.;

d) passing the intended feed stream through the second-stage reaction zone while further raising the inlet temperature of the reaction zone until at least 40 percent conversion of the feed stream is achieved; and, e) reducing the concentration of ammonia in the inlet to the second-stage reaction zone by reducing the injection of aqueous ammonia.

2. The process of claim 1 wherein the hydrocracking catalyst comprises a Y zeolite.

3. The process of claim 1 wherein the hydrocracking catalyst comprises a noble metal.

4. The process of claim 1 wherein the hydrocracking process is operated at an initial temperature less than 680 ° F.

5. The process of claim 1 wherein the hydrocracking process unit comprises a first and a second reaction stage with intermediate removal of ammonia from the effluent of the first reaction stage.

6. The process of claim 1 wherein the reaction zone contains a noble metal catalyst and the rate of aqueous ammonia injection is controlled to maintain the water concentration in the reactants entering the reaction zone at less than 13,000 ppm.

7. A process for starting operation of a two-stage hydrocracking process unit having a second-stage reaction zone containing fresh or newly regenerated zeolitic hydrocracking catalyst, which startup process comprises the steps of:

a) circulating a hydrogen-rich gas through the second-stage reaction zone while raising the inlet temperature of the second-stage reaction zone;

b) circulating liquid phase hydrocarbons through the second-stage reaction zone;

c) after the inlet temperature of the reaction zone reaches 350° F., injecting aqueous ammonia into a recycle gas line of the hydrocracking process unit at a rate sufficient to maintain an ammonia concentration in hydrogen-rich gas entering the second-stage reaction zone greater than 200 vppm.;

d) passing the intended feed stream through the second-stage reaction zone while further raising the inlet temperature of the second-stage reaction zone until at least 40 percent conversion of the feed stream is achieved; and, e) reducing the concentration of ammonia in the inlet to the second-stage reaction zone to within a range of 40 to 150 ppm by reducing the rate of injection of aqueous ammonia and then continuing operation of the process with a positive injection of aqueous ammonia sufficient to maintain an ammonia concentration in this range.

8. The process of claim 7 wherein the rate of aqueous ammonia injection is controlled such that the water concentration in the reactants entering the second-stage reaction zone is less than 26,000 ppm.

9. The process of claim 7 wherein the ammonia concentration in the recycle gas entering the second-stage reaction zone is raised to a concentration greater than 500 ppm during step (c).

* * * * *